US008955789B2

(12) United States Patent
Bitterolf et al.

(10) Patent No.: US 8,955,789 B2
(45) Date of Patent: Feb. 17, 2015

(54) METHOD FOR CONTROLLING A PROCESS FOR WINDING AN ACENTRIC COIL FORMER AND DEVICE OPERATING ACCORDING TO THE METHOD

(75) Inventors: David Bitterolf, Altdorf (DE); Elmar Schäfers, Fürth (DE); Stephan Schäufele, Erlangen (DE)

(73) Assignee: Siemens Aktiengesellschaft, München (DE)

( * ) Notice: Subject to any disclaimer, the term of this patent is extended or adjusted under 35 U.S.C. 154(b) by 438 days.

(21) Appl. No.: 13/363,965

(22) Filed: Feb. 1, 2012

(65) Prior Publication Data

US 2013/0026278 A1 Jan. 31, 2013

(30) Foreign Application Priority Data

Feb. 2, 2011 (EP) ..... 11152993

(51) Int. Cl.

| | |
|---|---|
| ***B21C 47/02*** | (2006.01) |
| ***H01F 41/06*** | (2006.01) |
| ***B65H 54/10*** | (2006.01) |
| ***B65H 59/38*** | (2006.01) |

(52) U.S. Cl.

CPC ..... *H01F 41/065* (2013.01); *B65H 54/10* (2013.01); *B65H 59/385* (2013.01); *B65H 59/387* (2013.01); *H01F 41/0679* (2013.01); *B65H 2701/36* (2013.01)

USPC ..... 242/443; 242/437.3; 242/437.4

(58) Field of Classification Search

USPC ..... 242/437, 437.1, 437.3, 437.4, 443

See application file for complete search history.

(56) References Cited

U.S. PATENT DOCUMENTS

| | | | | |
|---|---|---|---|---|
| 3,810,587 | A * | 5/1974 | Muskulus | 242/437.3 |
| 4,621,418 | A * | 11/1986 | Aharony et al. | 29/736 |

FOREIGN PATENT DOCUMENTS

| | | | | |
|---|---|---|---|---|
| CN | 101454850 | A | 6/2009 | |
| DE | 3634668 | A1 * | 4/1988 | H01F 41/06 |
| DE | 196 38 238 | C1 | 2/1998 | |
| EP | 0 926 090 | A2 | 6/1999 | |
| EP | 1306861 | A1 | 5/2003 | |
| EP | 2 031 610 | A1 | 3/2009 | |
| EP | 2031610 | A1 | 3/2009 | |
| JP | 01026345 | A * | 1/1989 | H02K 15/04 |
| JP | 6255884 | A | 9/1994 | |
| WO | WO 9812719 | A1 | 3/1998 | |

* cited by examiner

*Primary Examiner* — Emmanuel M Marcelo

(74) *Attorney, Agent, or Firm* — Henry M. Feiereisen LLC

(57) ABSTRACT

In a method and a device for winding an acentric coil former, the coil former is set into a rotary motion with a winder drive, wherein the rotary motion of the coil former causes a wire attached to the coil former to be wound onto the coil former and unwound from a drum operatively connected to a brake drive, and the winder drive or the brake drive, or both, are controlled based on a rotation position of the coil former. The wire is unwound from the drum with a non-constant speed.

14 Claims, 4 Drawing Sheets

R
L / 2
l / 2
r (θ1)
r (θ) [ m ]
0.06
0.05
0.04
0.03
0.02
0.01
0.00
0
0.5
1.0
1.5
θ [ U ]

32
36
28
34
θ1

R = 1/4 √(L² + l²)
l φ = arctan l/L
φ
R
L

METHOD FOR CONTROLLING A PROCESS FOR WINDING AN ACENTRIC COIL FORMER AND DEVICE OPERATING ACCORDING TO THE METHOD

CROSS-REFERENCES TO RELATED APPLICATIONS

This application claims the priority of European Patent Application, Serial No. EP11152993, filed Feb. 2, 2011, pursuant to 35 U.S.C. 119(a)-(d), the content of which is incorporated herein by reference in its entirety as if fully set forth herein.

BACKGROUND OF THE INVENTION

The present invention relates to a method for controlling a process for winding an acentric coil former. The invention furthermore relates also to a device operating according to the method, that is to say, for example, a control device which performs the method, or a wire wrapping machine having such a device.

The following discussion of related art is provided to assist the reader in understanding the advantages of the invention, and is not to be construed as an admission that this related art is prior art to this invention.

A coil former serves as the core of the winding that is to be produced. The winding is produced in a known manner from a plurality or a multiplicity of winding layers of an electrically conductive wire. In the case of coils, relays, solenoid switches, motor windings and the like, the coil former is a metal part, e.g. a parallelepiped-shaped metal part.

Acentric is used here and in the following description to describe coil formers of a type in which different points on the coil former surface are at different distances from a center point or a rotation axis of the coil former running through the center point. An example of an acentric coil former is a parallelepiped-shaped coil former in which the outer corner points are at the greatest distance from the rotation axis and in which all other points are at a shorter distance, down to a minimum distance at a point on the surface of the parallelepiped which results with a normal of one of the side faces through the center point. An acentric coil former is therefore effectively the opposite of a solid of revolution, e.g. a cylinder, in which all points on the cylinder surface are at an equal distance at least from a central or rotation axis.

Methods for controlling a process for winding a coil former and wire wrapping machines provided therefor are generally known. The winding of acentric coil formers is also known.

An important prerequisite for achieving a qualitatively satisfactory execution of a winding process is to maintain a tensile force acting on the wire during the winding process at a constant level. In the case of acentric coil formers, however, which is to say, for example, in the case of motor windings having parallelepiped-shaped coil former geometries, high surges and fluctuations in tensile force are produced during a winding cycle. Such tensile force surges can lead to the wound wire being damaged or even to a snapping of the wire. This is also disadvantageous if the wire experiences an undesirable longitudinal extension due to tensile force fluctuations and the result in the case of the wound coil is an inhomogeneity in the generated magnetic field.

It would therefore be desirable and advantageous to obviate prior art shortcomings and to provide an improved method for controlling a process for winding an acentric coil former which avoids the aforementioned disadvantages or at least reduces their impact. It would also be desirable and advantageous to disclose a method for controlling a process for winding an acentric coil former in which a reduction in a rotation speed of the coil former that is to be wound is avoided in order not to compromise a production capacity of a facility operating according to the method.

SUMMARY OF THE INVENTION

According to one aspect of the present invention, a method for controlling a process for winding an acentric coil former includes the steps of setting the coil former into a rotary motion with a winder drive, wherein the rotary motion of the coil former causes a wire attached to the coil former to be wound onto the coil former and unwound from a drum operatively connected to a brake drive, and controlling the winder drive or the brake drive, or both, based on a rotation position of the coil former.

The invention is based on the knowledge that due to the geometry of acentric coil formers, an unwinding speed from the drum on which the wire used for wrapping the coil former is stored is not constant and depends on a rotation position of the coil former. The change in the unwinding speed as a function of the rotation position of the coil former can be computed from simple mathematical relationships.

With the invention, either the winder drive or the brake drive, or both drives, namely the winder drive and the brake drive, may advantageously be controlled by detecting the rotation position of the coil former so as to maintain a constant or at least substantially uniform tensile force acting on the wire.

Advantageous embodiments of the invention may include one or more of the following features.

According to one advantageous feature of the present invention, although a speed at which the wire is unwound from the drum is not constant, the drives are controlled in such a way as to produce a constant rotation speed of the winder drive. The coil former is therefore rotated at a constant speed of rotation, with this speed being the determining factor for the potential number of coil formers wrapped in one time unit. A constant rotation speed therefore leads to a predictable production volume. Moreover, a constant rotation speed of the winder drive leads to an increase in the production volume, in contrast to a rotation speed which is dynamically reduced below the value of the constant rotation speed depending on the rotation position of the coil former.

If a motion or speed profile of the drum is calculated for a plurality of rotation positions of the coil former and corresponding rotation positions of the drum and used as a basis for controlling the brake drive, the winder drive may be controlled so as to rotate at a constant rotation speed and the wire unwinding dynamics, i.e. an unwinding speed that varies with the rotation position of the coil former, is compensated for by means of appropriate control of the brake drive. Furthermore, it is sufficient with regard to the speed profile of the drum to determine or calculate said profile once only. As soon as the speed profile, which essentially is dependent only on the geometry of the coil former, is established, it can be used for the currently running winding process or for further winding processes using coil formers having the same geometry. For a plurality of rotation positions of the coil former and corresponding rotation positions of the drum, the motion or speed profile includes always position, motion or speed setpoint values for controlling the brake drive. All conceivable profiles, i.e. in particular position, motion, speed and acceleration profiles, are referred to here and in the following as a speed profile, without renunciation of a more far-reaching meaning, which is also justified by the fact that an acceleration profile can be derived from a speed profile through differentiation and a position profile can be obtained from a speed profile through integration. With regard to the plurality of rotation positions for which the speed profile is calculated, suitable examples are ninety, one hundred, one hundred and eighty, three hundred and sixty, seven hundred and twenty, one thousand, etc. rotation positions, which are distributed evenly over one full revolution. In a comparatively simple situation with three hundred and sixty values considered, each rotation position relates to an angular position of the coil former corresponding to the respective value and the speed profile for the drum correspondingly comprises a position or speed setpoint value or the like for each integral angular value measured in degrees.

According to another advantageous feature of the present invention, the speed profile of the drum may be calculated, on the one hand, on the respective rotation position of the coil former and, on the other hand, on a corresponding distance of a current bearing point or contact point of the wire on the coil former from a rotation axis of the coil former. This maps the actual relationships with great accuracy. At least the accuracy is greater than would be possible with an approximation of the geometry of the coil former. Maximum unwinding speeds during operation are produced when the distance between bearing point and rotation axis is at its greatest.

If the speed profile of the drum is supplied as an input variable or setpoint value to a feedback control circuit for controlling the brake drive, in contrast, for example, to a direct control of the brake drive by means of the respective speed value of the speed profile, any deviations from the respective speed value supplied as the setpoint value may be compensated by the feedback control functionality of the feedback control circuit.

If the feedback control circuit for controlling the brake drive includes a controller which is effective for maintaining a constant tensile force applied to the wire by the brake drive, the feedback control circuit not only takes into account the speed setpoint values from the speed profile, but is also effective in respect of stabilizing a predefined or predefinable tensile force. For this purpose a torque feedback from the brake drive is provided, wherein a difference from a fed-back torque and a force setpoint value supplied as the predefined tensile force is supplied to the controller as an input signal. During operation the controller included in the feedback control circuit for the purpose of maintaining a constant tensile force furthermore attenuates the manipulated variable that is output in each case.

The feedback control circuit for controlling the brake drive may be implemented with a PI controller, although in principle any other standard controller or combinations thereof may be used, and a current controller and, as the controller for maintaining a constant tensile force on the wire, a PI controller in the feedback path. If the controller for maintaining a constant tensile force is disposed in the feedback path of the feedback control circuit, the output of this controller can influence a rotation speed specification downstream of a setpoint value specification based on the speed profile.

A feedback control circuit comprising a PI controller and a current controller may be employed to implement the controller for maintaining a constant rotation speed of the winder drive. In this case, too, any other standard controller or combinations thereof may basically be used instead of the PI controller. By using a feedback control concept realized by means of a feedback control circuit it is possible, in contrast, for example, to a direct control of the winder drive by means of the respective setpoint rotation speed, to compensate for any deviations from the setpoint rotation speed.

If the control of the winder drive and the control of the brake drive are implemented as a feedback position control, an appropriate speed or rotation speed setpoint value of the winder drive and of the brake drive can be associated with any rotation position of the coil former.

According to another advantageous feature of the present invention, a dynamic force resulting from the non-constant speed at which the wire is unwound from the drum due to the control of the drives, in particular the feedback control, may be distributed onto the winder drive on the one hand and the brake drive on the other. Unlike in the case of the above-described variant, in which the drives are controlled so as to produce a constant rotation speed of the winder drive, both drives are now involved in compensating for the dynamics of the wire unwinding process. A possible way of achieving such a distribution onto both drives consists in the modeling of the coil former by means of rounded geometries. This entails describing spatial points on the surface of the coil former starting from the rotation axis by means of a distance function. This, like any other function, may be broken down by means of Fourier decomposition into terms of first, second and higher order. Higher-order terms, i.e. high-frequency components of the modeling, are in this case added to a setpoint value for the brake drive, while terms below a predefined or predefinable order can be used for calculating a motion profile for the winder drive, from which motion profile rotation speed setpoint values for the winder drive are yielded in each case. With the motion profile and its rotation speed setpoint values, a constant wire unwinding rate is produced per time unit.

According to another aspect of the invention, a control device for controlling winding of an acentric coil former with wire unwound from a drum includes a braking control circuit controlling a brake drive operatively connected to the drum and a winding control circuit controlling a winder drive configured to impart a rotary motion on the coil former, wherein the rotary motion of the coil former causes the wire attached to the coil former to be wound onto the coil former and unwound from the drum. The winder drive and/or the brake drive are controlled based on a rotation position of the coil former and the wire may be unwound from the drum at a non-constant speed.

According to another aspect of the invention, a computer program is embodied in a non-transitory computer-readable medium for controlling a process for winding an acentric coil former, wherein the program, when read into a memory of a computer, causes the computer to set the coil former into a rotary motion with a winder drive, wherein the rotary motion of the coil former causes a wire attached to the coil former to be wound onto the coil former and unwound from a drum operatively connected to a brake drive, and control the winder drive or the brake drive, or both, based on a rotation position of the coil former. The wire may be unwound from the drum with a non-constant speed.

According to yet another aspect of the invention, a non-transitory storage medium contains a computer program for controlling a process for winding an acentric coil former, wherein the program, when read into computer memory, causes the computer to perform the steps of the method. Another aspect of the invention relates to a wire wrapping machine with a control device for controlling winding of an acentric coil former, wherein the wire wrapping machine includes a drum having a supply of wire and being operatively connected to a brake drive, and a winder drive configured to set the coil former into a rotary motion, wherein the rotary motion of the coil former causes the wire attached to the coil former to be wound onto the coil former and unwound from a drum. The control device controls the winder drive or the brake drive, or both, based on a rotation position of the coil former, wherein the wire may be unwound from the drum at a non-constant speed.

BRIEF DESCRIPTION OF THE DRAWING

Other features and advantages of the present invention will be more readily apparent upon reading the following description of currently preferred exemplified embodiments of the invention with reference to the accompanying drawing, in which.

DETAILED DESCRIPTION OF PREFERRED EMBODIMENTS

Figure 1:
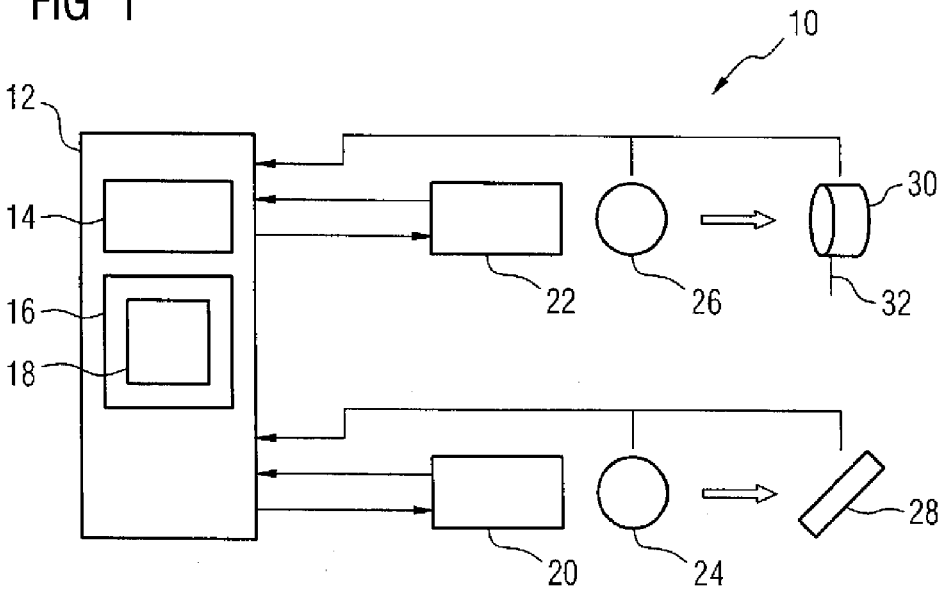
FIG. 1 shows a schematic diagram of a wire wrapping machine.

Throughout all the figures, same or corresponding elements may generally be indicated by same reference numerals. These depicted embodiments are to be understood as illustrative of the invention and not as limiting in any way. It should also be understood that the figures are not necessarily to scale and that the embodiments are sometimes illustrated by graphic symbols, phantom lines, diagrammatic representations and fragmentary views. In certain instances, details which are not necessary for an understanding of the present invention or which render other details difficult to perceive may have been omitted.

Turning now to the drawing, and in particular to FIG. 1, there is shown a greatly simplified schematic diagram of a wire wrapping machine designated overall by reference numeral 10. The machine includes a conventional control device 12 having a processing unit in the form of a microprocessor 14 or the like. The processing unit is provided for executing during the operation of the wire wrapping machine 10 a control program 18 residing in the form of a computer program containing computer program instructions in a memory 16. Under the control of the control device 12 at least one winder drive 20 and one brake drive 22 are controlled through execution of the control program 18. The winder drive 20 and the brake drive 22 each act on a downstream motor 24, 26, respectively, or the like. The combination of drive and downstream motor is also referred to here and in the following in summary as a drive. In that respect the winder drive 20 effects a rotation of a coil former 28 requiring to be wrapped and the brake drive 22 effects a rotation of a drum 30. During operation a wire 32 is unwound from the drum 30. Said wire is guided to the coil former 28 and wound there onto the latter by means of the rotation of the coil former 28.

In the case of an acentric coil former 28, i.e. for example a coil former having the parallelepiped-shaped geometry shown in FIG. 1, the wire wrapping machine 10 as a whole or the control device 12 of the wire wrapping machine 10 executes a process for winding an acentric coil former 28. During said process, data or control signals are exchanged in a known manner between the various units of the wire wrapping machine 10. This can be, for example, data from the control device 12 to the respective drive 20, 22 containing activation signals or motion data, for example data for specifying a position, speed or rotation speed. The drives 20, 22 can supply status data to the control unit 12 for monitoring or feedback control purposes. This can be, for example, data concerning the current operating status or the position, speed or rotation speed at the present instant. Corresponding data can additionally or alternatively also be accepted in the case of the respective motors 24, 26 or the coil former 28 or the drum 30. Signal or data transmission of this kind is known and will therefore not be discussed in further detail.

Figure 2:
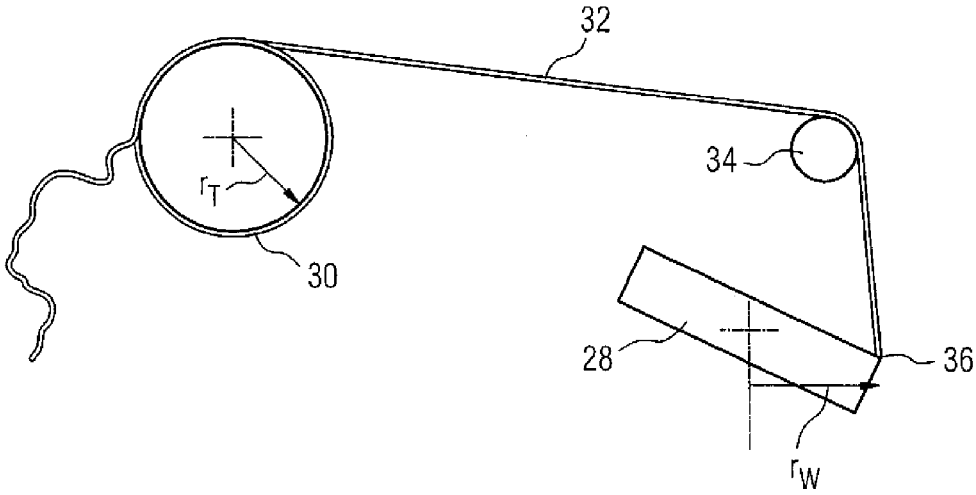
FIG. 2 shows a schematic diagram of a winding of an acentric coil former.

FIG. 2 shows a greatly simplified schematic diagram of a winding of an acentric coil former 28. By means of a rotation of the coil former 28 wire 32 is unwound from the drum 30 and wrapped onto the coil former 28. In the situation illustrated the wire 32 is guided over a diverter roller 34. The wire 32 comes into contact with the coil former 28 at in each case at least one point on its surface. Said point is referred to in the following as bearing point 36. Depending on the rotation position of the coil former 28, the bearing point 36 lies on one of the edges or one of the faces of the coil former 28.

The aforementioned tensile force surges and tensile force fluctuations during a winding cycle which are produced in the case of acentric coil formers 28, i.e. for example in the case of motor windings having parallelepiped-shaped coil former geometries, are essentially caused by the varying distance, according to the rotation position of the coil former 28, between bearing point 36 and a rotation axis (in FIG. 2 at the point of intersection of the dashed lines) of the coil former 28. The current distance for the situation shown in FIG. 2 is entered as rW. Basically, the tensile force acting on the wire 32 is also dependent on the decreasing radius of the wire windings on the drum 30 as the winding cycle proceeds (designated as rT in FIG. 2). In a special embodiment variant of the wire wrapping machine 10, a drum on which the stock of wire is wound is followed by a further drum 30 on which only a limited number of windings, for example ten windings, is conveyed at all times and wherein, owing to a truncated-cone-shaped geometry, the uncoiled winding in each case always tends toward the location of the minimum diameter, with the result that the unwinding diameter rT of said drum 30 is constant. Designated here and in the following as drum 30 is either such a drum having a constant unwinding diameter or, in the case of wire wrapping machines 10 having no such drum, the drum containing the stock of wire.

Figures 3A, 3B, 3C, 3D, 3E, 3F, 3G:
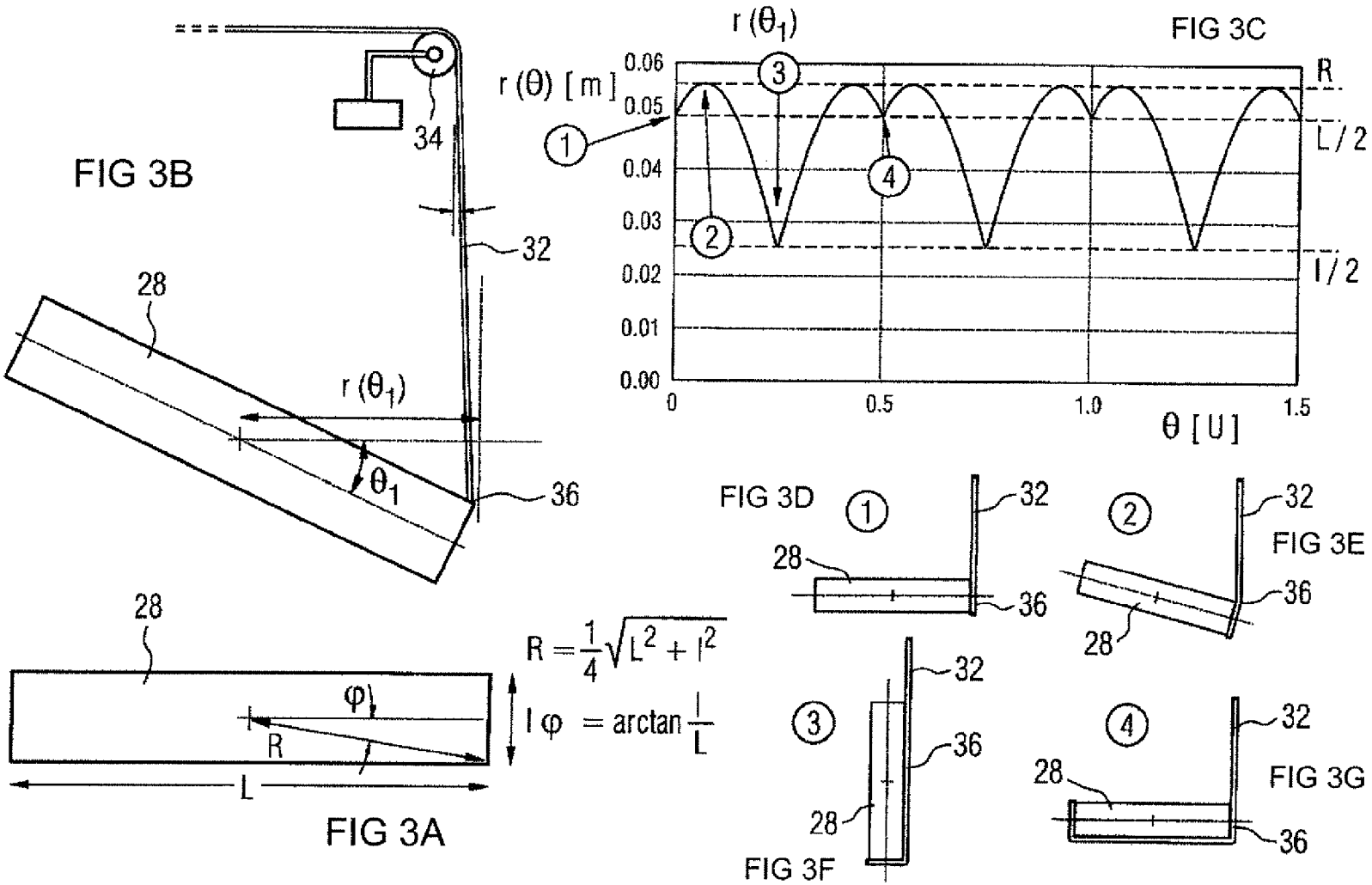
FIG. 3A shows an exemplary geometry of an acentric coil former.
FIG. 3B shows schematically a definition of a distance function for the acentric coil former of FIG. 3A.
FIG. 3C shows schematically a curve of the distance function for the acentric coil former of FIG. 3A, FIGS. 3D to 3G show the coil former at the rotation positions (1) through (4) of FIG. 3C.

During a rotation of the coil former 28 shown in FIG. 2 and the drum 30 likewise shown in FIG. 2, the wire wrapping machine 10 shown in FIG. 1 performs a method for controlling a process for winding an acentric coil former 28, wherein the coil former 28 is set into a rotary motion by means of the winder drive 20 (FIG. 1), wherein a rotary motion of the coil former 28 causes a wire 32 attached thereto to be wound onto the coil former 28 and unwound from the drum 30 which is associated with the brake drive 22 (FIG. 1). In the process the control device 12 (FIG. 1) of the wire wrapping machine 10 effects a control, in particular by feedback control means, of the winder drive 20 (FIG. 1) and/or of the brake drive 22 (FIG. 1) on the basis of a respective rotation position of the coil former 28. A possible approach to implementing such a control and a method based thereon are described below:

FIG. 3A shows an exemplary geometry of an acentric coil former and the mathematical relationships resulting therefrom. FIG. 3B shows in the form of a detail from the schematic shown in FIG. 2 the geometric meaning of a distance function—designated here as r(Θ1)—in a rotation position, designated by the angle Θ1, of the coil former 28. The distance function r(Θ1) is a description of a change in a distance of the bearing point 36 from the rotation axis over different rotation positions Θ1 of the coil former 28 during progressive rotation or over time.

FIG. 3C shows the shape of the distance function r(Θ1) for a full and a following half revolution of the coil former 28, wherein individual significant rotation positions (1), (2), (3) and (4) of the coil former 28 with the respective bearing point 36 of the wire 32 are shown as snapshots in FIG. 3D through FIG. 3G, respectively. The individual rotation positions are designated there and on the distance function by (1), (2), (3) and (4).

Figure 4:
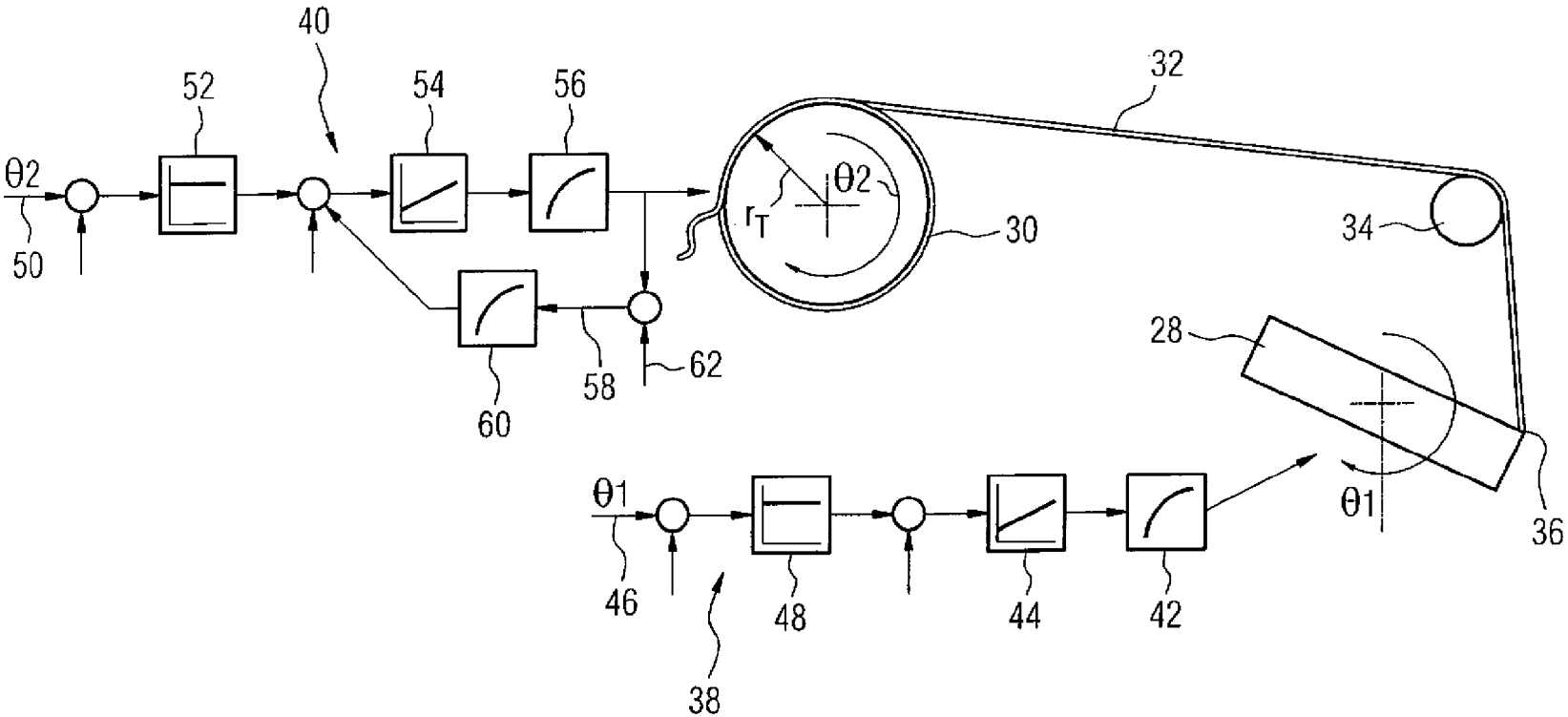
FIG. 4 shows block diagrams for structures of a feedback control circuit for controlling the drives of the wire wrapping machine.

FIG. 4 shows essentially a repetition of the schematic diagram from FIG. 2 and in each case, associated graphically with the coil former 28 and the drum 30, a feedback control circuit for controlling the winder drive 20 and the brake drive 22. For differentiation purposes the two feedback control circuits are designated in the following as winding feedback control circuit 38 and braking feedback control circuit 40.

In the embodiment variant shown in FIG. 4 the winding feedback control circuit 38 is provided in order to produce, by feedback control means, a constant rotation speed of the winder drive 20—even though the wire 32 is unwound from the drum 30 at a speed which is not constant. Toward that end the winding feedback control circuit 38 includes in a known manner a current controller, designated in the following for differentiation purposes as winding feedback control circuit current controller 42. Connected upstream of the latter is a PI controller, likewise designated for differentiation purposes as winding feedback control circuit PI controller 44. Setpoint values for the rotation position of the coil former 28 (designated as θ1 in the diagram) are specified to the winding feedback control circuit 38 continuously or at equidistant intervals, i.e. discretely, at a winding feedback control circuit input 46. A rotation speed setpoint value is calculated therefrom by means of a proportional element designated for differentiation purposes as winding feedback control circuit proportional element 48. Said value serves as an input signal for the winding feedback control circuit PI controller 44 and the thus resulting output signal of the winding feedback control circuit current controller 42 can be output to the winder drive 20 for maintaining a constant rotation speed of the motor 24 (FIG. 1) controlled by means of the winder drive 20 (FIG. 1) and consequently finally for maintaining a constant rotation speed of the coil former 28. A feedback (only partially shown) of the actual rotation speed of the coil former 28 at a given instant closes the winding feedback control circuit 38 and permits a compensation for any deviations from the rotation speed specification at the output of the winding feedback control circuit proportional element 48. In addition a respective actual position value is fed back to the winding feedback control circuit input 46 in order to reach the predefined position setpoint value.

While angular values that basically increase cyclically at a steady rate are transmitted to the winding feedback control circuit 38 for maintaining a constant rotation speed of the coil former 28, from which values the respective setpoint rotation speed is then yielded, the braking feedback control circuit 40 is provided for compensating for the dynamics of the wire unwinding process. For this purpose a position, motion or speed profile of the drum 30 is first calculated for a plurality of rotation positions of the coil former 28 and corresponding rotation positions of the drum 30 and used as a basis for controlling the brake drive 22. From such a profile, referred to in the following in summary as a speed profile, there results in each case a desired rotation position of the drum 30.

For the embodiment variant shown, the speed profile of the drum 30 is therefore calculated for a plurality of rotation positions of the coil former 28 from the respective rotation position (Θ1) and a distance resulting therefrom of the current bearing point 36 of the wire 32 at each instant from the rotation axis of the coil former 28. The position of the bearing point 36 is described therein by means of the distance function r(Θ1) (FIG. 3C). The distance function itself is normalized to the distance of the respective point on the surface of the coil former from its axis of symmetry or rotation axis used for the winding, such that the respective value of the distance function indicates the distance of the bearing point 36 from the rotation axis of the coil former 28.

A rotation speed profile and, proceeding therefrom, the speed profile can be calculated on the basis of the following mathematical relationships, which basically constitute a transformation of the distance function r(Θ1) shown in FIG. 3C, for the greater the value of the distance function, the greater must be the speed of the drum 30 in order to enable the wire to continue to be unwound at a constant wire tension in spite of the increasingly great deflection of the wire. Conversely, for smaller values of the distance function the speed of the drum 30 must decrease in order on the one hand to avoid a breaking of the wire tension and on the other hand to ensure a continuing constant wire tension.

Initially it can be assumed that the speed of the wire 32 is the same at any time in the entire system:

$$\dot{\theta}_1 r(\theta_1) = r_T \dot{\theta}_2 = v_0$$

The length of the wire 32 unwound from the drum 30 then corresponds to the length of wire wrapped onto the coil former 28, where r(u) is the distance function on the left-hand side and the unwound length of wire is yielded from the unwinding speed of the wire 32:

$$\int_0^{\theta_1} r(u)\,du = v_0 t$$

Substituting results in $$\int_0^{\theta_1} r(u)\,du = r_T \theta_2 + L_0$$

where $L_0$ specifies a free length of the wire 32 between the drum 30 and the coil former 28.

The derivatives of θ1 and θ2 over time are the rotation speed profile of the coil former 28 and of the drum 30, respectively. The result therefrom in each case is a speed profile, and from the speed profile for the drum 30 is yielded a rotation position profile for the drum 30 such that the rotation position profile encodes the rotation positions that are to be successively assumed by the drum 30. The rotation position profile or a current value from the rotation position profile at a given instant is supplied to the braking feedback control circuit 40 at its braking feedback control circuit input 50 (designated as θ2 in the diagram). The braking feedback control circuit 40 is therefore the feedback control circuit to which the speed profile of the drum 30 is supplied as input variable for controlling the brake drive 22.

A rotation speed setpoint value is calculated therefrom by means of a proportional element referred to as braking feedback control circuit proportional element 52 in order to differentiate it from the winding feedback control circuit proportional element 48. Said value serves as an input signal for the braking feedback control circuit PI controller 54 and the thus resulting output signal of a braking feedback control circuit current controller 56 connected downstream of the braking feedback control circuit PI controller 54 can be output to the brake drive 22 (FIG. 1) for the purpose of maintaining the desired speed profile of the motor 26 (FIG. 1) controlled by means of the brake drive, and consequently finally for maintaining the desired rotational behavior of the drum 30 in order to compensate for the dynamics of the wire unwinding process. A feedback (only partially shown) of the actual rotation speed of the drum 30 at a given instant closes the braking feedback control circuit 40 and permits a compensation for any deviations from the specification at the output of the braking feedback control circuit proportional element 52. In addition, a respective actual position value is fed back to the braking feedback control circuit input 50 in order to reach the predefined position setpoint value. As a result the braking feedback control circuit causes the rotary motion of the drum 30 to follow the calculated speed profile and consequently a constant tensile force on the wire 32 to be maintained.

Optionally, as already indicated in FIG. 4, the braking feedback control circuit 40 can additionally include, in a separate feedback path 58, a PI controller that is effective for torque feedback and for differentiation purposes is designated as tensile force controller 60. At its input the tensile force controller 60 is supplied with a difference from the output signal of the braking feedback control circuit current controller 56 and a tensile force setpoint value signal 62. An output signal of the tensile force controller 60 is routed to the summation point following the braking feedback control circuit proportional element 52 and consequently influences the signal that is present at the input of the braking feedback control circuit PI controller 54. Accordingly, not only is a constant tensile force achieved, but also a tensile force corresponding to a setpoint value specification.

When reference is made here to a specific type of standard controller, for example the braking feedback control circuit PI controller, it is implied thereby that other forms of standard controller, for example a PID controller, are also considered suitable.

Figure 5:
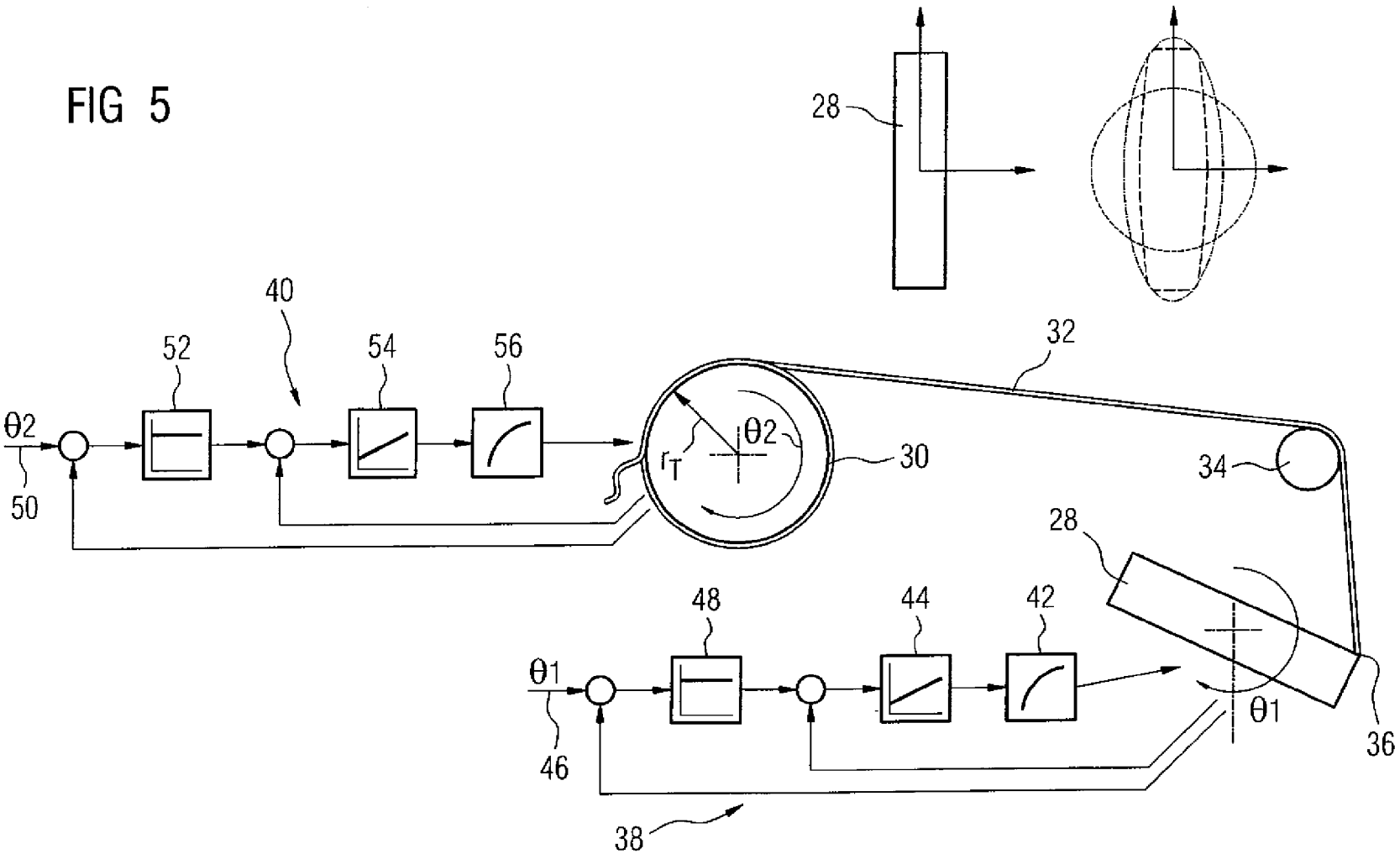
FIG. 5 shows block diagrams for alternative structures of a feedback control circuit for controlling the drives of the wire wrapping machine.

FIG. 5 shows an alternative embodiment variant of the control of the drives 20, 22. The prerequisite remains that a speed at which the wire 32 is unwound from the drum 30 is not constant. In contrast to the embodiment variant shown in FIG. 4, in which the rotation speed of the winder drive 20 was kept constant, the feedback control of the drives 20, 22 in this case causes the compensation for the dynamics of the wire unwinding process to be divided over the brake drive 22 and the winder drive 20. In this case, therefore, both drives 20, 22 are involved in compensating for the dynamics of the wire unwinding process.

This approach is based on a Fourier decomposition of the distance function (FIG. 2). Generally, the Fourier-decomposed distance function can be written as $r(\theta 1)=r1(\theta 1)+r2(\theta 1)$, where $r1(\theta 1)$ denotes lower-order terms and $r2(\theta 1)$ higher-order terms. Shown at top right in FIG. 5 in this regard is firstly the coil former and next to it the modeling of the coil former 28 as a function of a number of terms resulting after the Fourier decomposition of the distance function. When taking only one term into account (first-order term; first Fourier component), the coil former 28 is modeled as a circle. When taking two terms into account (first- and second-order terms), the coil former 28 is modeled as an ellipse. When taking three terms into account (first-, second- and third-order terms), the coil former 28 is modeled by an elliptical shape, wherein the minor axis already approximates better to the actual width of the coil former and the major axis does not extend beyond the actual length of the coil former. Adding further terms successively improves the modeling.

According to the alternative approach, a Fourier decomposition of the distance function $r(\theta 1)$ results in a specific number of terms. Terms below a predefined or predefinable order, i.e. for example the first- and second-order terms, are used for calculating a motion profile of the winder drive 20. Such a motion profile leads to (see representation of the distance function in FIG. 2) the rotation speed or speed of the winder drive 20 being reduced if there is an increase in the value of the distance function $r(\theta 1)$, in this case, therefore, the sum of the terms $r1(\theta 1)$ determined in that regard, in order to enable the wire to be unwound evenly without increasing the wire tension in the process. Conversely, the rotation speed or speed of the winder drive 20 can be increased up to a predefined rotation speed if the value of the distance function decreases. In contrast, the sum of the determined terms above the predefined or predefinable order is added to a setpoint value of the brake drive 22. Such a setpoint value of the brake drive is produced in this case firstly on the basis of the geometric relationships between coil former 28 and drum 30, i.e. a drum 30 with a considerably greater radius than an effective radius of the coil former 28 is initially operated at a reduced rotation speed as setpoint value compared with the rotation speed of the coil former 28. During operation said setpoint value is adjusted by the sum of the determined terms above the predefined or predefinable order.

With regard to the structure of the two feedback control circuits, i.e. winding feedback control circuit 38 and braking feedback control circuit 40, there are no systematic differences from the situation described with reference to FIG. 4, so the reader can be referred to the description presented there.

The fact that in both cases the control of the winder drive 20 by means of the winding feedback control circuit 38 and the control of the brake drive 22 by means of the braking feedback control circuit 40 is implemented each time in the form of a position control means that it is sufficient on the one hand (FIG. 4) to specify a constant rotation speed for the winder drive 20 and to specify a rotation speed according to a speed profile for the brake drive 22 that is dependent on the distance function and on the other hand (FIG. 5) to specify the rotation speed according to a speed profile that is dependent in each case on the distance function, in order to compensate for the dynamics of the wire unwinding process and achieve a uniform wrapping of the coil former 28.

The method described here is preferably implemented in software and in that respect the control program 18 comprises program code instructions for realizing the method and/or its embodiments. The feedback control circuits, i.e. winding feedback control circuit 38 and braking feedback control circuit 40, can likewise be implemented as part of the control program 18 or by suitable parameterization of the respective drives 20, 22.

Accordingly, individual prominent aspects of the description submitted here can be briefly summarized as follows: The invention relates to a method for controlling a process for winding an acentric coil former 28 and to a device operating according to the method, wherein the coil former 28 is set into a rotary motion by means of a winder drive 20, wherein a rotary motion of the coil former 28 causes a wire 32 attached thereto to be wound onto the coil former 28 and unwound from a drum 30 which is associated with a brake drive 22, and wherein the winder drive 20 and/or the brake drive 22 are/is controlled on the basis of a respective rotation position of the coil former 28.

While the invention has been illustrated and described in connection with currently preferred embodiments shown and described in detail, it is not intended to be limited to the details shown since various modifications and structural changes may be made without departing in any way from the spirit and scope of the present invention. The embodiments were chosen and described in order to explain the principles of the invention and practical application to thereby enable a person skilled in the art to best utilize the invention and various embodiments with various modifications as are suited to the particular use contemplated.

What is claimed is:

1. A method for controlling a process for winding an acentric coil former, comprising the steps of:

setting the coil former into a rotary motion with a winder drive, wherein the rotary motion of the coil former causes a wire attached to the coil former to be wound onto the coil former and to be unwound from a drum operatively connected to a brake drive with a non-constant speed, controlling the winder drive or the brake drive, or both, based on a rotation position of the coil former, and controlling a rotation speed of the winder drive and the brake drive so as to maintain a constant rotation speed of the winder drive.

2. The method of claim 1, further comprising the steps of:

calculating a speed profile of the drum for a plurality of, rotation positions of the coil former and for corresponding rotation positions of the drum that correspond to the rotation positions of the coil former, and controlling the brake drive based on the calculated speed profile.

3. The method of claim 2, wherein the speed profile of the drum is calculated from a current rotation position of the coil former and a corresponding distance of a current bearing point of the wire from a rotation axis of the coil former.

4. The method of claim 3, wherein the speed profile of the drum is supplied as an input variable to a feedback control circuit which controls the brake drive.

5. The method of claim 4, wherein the feedback control circuit includes a controller which causes the brake drive to maintain a constant tensile force on the wire.

6. The method of claim 5, wherein the feedback control circuit includes a first PI controller and a first current controller, and a second PI controller disposed in a feedback path of the feedback control circuit for maintaining the constant tensile force on the wire.

7. The method of claim 1, wherein the constant rotation speed of the winder drive is maintained by a feedback control circuit comprising a third PI controller and a second current controller.

8. The method of claim 1, wherein the winder drive and the brake drive are each controlled by a position control.

9. A method for controlling a process for winding an acentric coil former, comprising the steps of:

setting the coil former into a rotary motion with a winder drive, wherein the rotary motion of the coil former causes a wire attached to the coil former to be wound onto the coil former and unwound from a drum operatively connected to a brake drive with a non-constant speed, and controlling the winder drive or the brake drive, or both, based on a rotation position of the coil former, wherein the winder drive and the brake drive are controlled so as to distribute compensation of a dynamic force onto the winder drive and the brake drive, when the wire is unwound from the drum.

10. A computer program embodied in a non-transitory computer-readable medium for controlling a process for winding an acentric coil former, wherein the program, when read into a memory of a computer, causes the computer to:

set the coil former into a rotary motion with a winder drive, wherein the rotary motion of the coil former causes a wire attached to the coil former to be wound onto the coil former and unwound from a drum operatively connected to a brake drive, and control the winder drive or the brake drive, or both, based on a rotation position of the coil former, wherein the wire is unwound from the drum with a non-constant speed.

11. A control device comprising the computer program of claim 10.

12. A non-transitory data medium comprising a computer program for controlling a process for winding an acentric coil former, wherein the program, when read into computer memory, causes the computer to:

set the coil former into a rotary motion with a winder drive, wherein the rotary motion of the coil former causes a wire attached to the coil former to be wound onto the coil former and unwound from a drum operatively connected to a brake drive, and control the winder drive or the brake drive, or both, based on a rotation position of the coil former, wherein the wire is unwound from the drum with a non-constant speed.

13. A control device for controlling winding of an acentric coil former with wire unwound from a drum, comprising:

a braking control circuit controlling a brake drive operatively connected to the drum, a winding control circuit controlling a winder drive configured to impart a rotary motion on the coil former, wherein the rotary motion of the coil former causes the wire attached to the coil former to be wound onto the coil former and unwound from the drum, wherein the winder drive or the brake drive are controlled based on a rotation position of the coil former and the wire is unwound from the drum with a non-constant speed.

14. A wire wrapping machine with a control device for controlling winding of an acentric coil former, comprising:

a drum having a supply of wire and being operatively connected to a brake drive, a winder drive configured to set the coil former into a rotary motion, wherein the rotary motion of the coil former causes the wire attached to the coil former to be wound onto the coil former and unwound from the drum, wherein the control device controls the winder drive or the brake drive, or both, based on a rotation position of the coil former and the wire is unwound from the drum with a non-constant speed.

* * * * *